US012773075B2

(12) United States Patent
Kuylenstierna et al.

(10) Patent No.: US 12,773,075 B2
(45) Date of Patent: Oct. 27, 2026

(54) METHOD FOR EVALUATING A STATUS OF A DISPENSER AND A DISPENSER

(71) Applicant: Essity Hygiene and Health Aktiebolag, Gothenburg (SE)

(72) Inventors: Jonas Kuylenstierna, Gothenburg (SE); Gunilla Himmelmann, Gothenburg (SE)

(73) Assignee: ESSITY HYGIENE AND HEALTH AKTIEBOLAG, Gothenburg (SE)

( * ) Notice: Subject to any disclaimer, the term of this patent is extended or adjusted under 35 U.S.C. 154(b) by 49 days.

(21) Appl. No.: 18/562,117

(22) PCT Filed: May 25, 2021

(86) PCT No.: PCT/EP2021/063856

§ 371 (c)(1),
(2) Date: Nov. 17, 2023

(87) PCT Pub. No.: WO2022/248017

PCT Pub. Date: Jan. 12, 2022

(65) Prior Publication Data

US 2024/0260793 A1 Aug. 8, 2024

(51) Int. Cl.
*A47K 10/42* (2006.01)
*A47K 10/32* (2006.01)

(52) U.S. Cl.
CPC .... *A47K 10/426* (2013.01); *A47K 2010/3226* (2013.01)

(58) Field of Classification Search
CPC ..... A47K 10/426; A47K 2010/3226; A47K 10/3687; A47K 10/36; A47K 10/3625;
(Continued)

(56) References Cited

U.S. PATENT DOCUMENTS 3,007,650 A * 11/1961 Burton ..... A47K 10/36 312/34.19
3,050,224 A * 8/1962 Einar ..... A47K 10/38 225/88

(Continued)

FOREIGN PATENT DOCUMENTS

CN 1408064 A 4/2003
CN 1886637 A 12/2006

(Continued)

OTHER PUBLICATIONS

International Search Report for International Application No. PCT/EP2021/063856; International Filing Date: May 25, 2021; Date of Mailing: Feb. 2, 2022; 4 pages.

(Continued)

*Primary Examiner* — Rakesh Kumar
(74) *Attorney, Agent, or Firm* — CANTOR COLBURN LLP

(57) ABSTRACT

The disclosure relates to a method for evaluating a status of a dispenser for dispensing a sheet product for wiping, said dispenser comprising sensor, such as a radar sensor; said sensor being configured to emit a sensor beam; the method comprising: —Providing a sensor echo signal indicative of a distance from said sensor to one or more reflective surfaces at least partially reflecting said sensor beam, wherein one of said one or more reflective surfaces is said boundary surface, using said sensor; and —Determining a status of said dispenser using said sensor echo signal. The method further relates to a dispenser, to a control unit and to a computer program for performing the method.

34 Claims, 6 Drawing Sheets

(58) Field of Classification Search
CPC ..... A47K 10/3656; A47K 10/3827; A47K 10/24; A47K 10/38
USPC ..... 221/6; 34/90
See application file for complete search history.

(56) References Cited

U.S. PATENT DOCUMENTS 3,126,234 A * 3/1964 Batlas ..... A47K 10/32 242/596.7
3,276,706 A * 10/1966 House ..... A47K 10/38 226/110
3,288,387 A * 11/1966 Craven, Jr. ..... A47K 10/3687 242/560.1
3,628,743 A * 12/1971 Bastian ..... A47K 10/32 242/560.1
3,917,191 A * 11/1975 Graham, Jr. ..... A47K 10/36 242/596.4
4,010,909 A * 3/1977 Bastian ..... A47K 10/3687 226/91
4,067,509 A * 1/1978 Graham, Jr. ..... A47K 10/36 242/560.1
4,137,805 A * 2/1979 DeLuca ..... A47K 10/3687 226/110
4,148,442 A * 4/1979 Baumann ..... B65H 19/10 242/560.1
4,165,138 A * 8/1979 Hedge ..... A47K 10/3656 242/564.4
4,264,403 A * 4/1981 Emmel ..... B65C 11/00 156/154
4,307,638 A * 12/1981 DeLuca ..... A47K 10/3643 83/345
4,317,547 A * 3/1982 Graham, Jr. ..... A47K 10/3687 242/560.1
4,358,169 A * 11/1982 Filipowicz ..... A47K 10/3637 225/8
4,367,666 A * 1/1983 Toth ..... B65H 35/08 83/272
4,378,912 A * 4/1983 Perrin ..... A47K 10/3637 226/91
4,487,375 A * 12/1984 Rasmussen ..... A47K 10/40 226/174
4,552,315 A * 11/1985 Granger ..... A47K 10/3643 242/560.3
4,691,503 A * 9/1987 Frerich ..... B65B 41/12 53/118
4,756,485 A * 7/1988 Bastian ..... A47K 10/3687 242/560.1
4,846,412 A * 7/1989 Morand ..... A47K 10/3687 225/106
5,161,723 A * 11/1992 Wirtz-Odenthal ..... A47K 10/3687 225/14
5,244,161 A * 9/1993 Wirtz-Odenthal ..... A47K 10/3687 242/563.2
5,271,574 A * 12/1993 Formon ..... A47K 10/36 242/560.3
5,294,192 A * 3/1994 Omdoll ..... A47K 10/3687 242/564.4
5,400,982 A * 3/1995 Collins ..... A47K 10/36 242/564.4
5,604,992 A * 2/1997 Robinson ..... A47K 10/485 242/560
5,954,256 A * 9/1999 Niada ..... A47K 10/3836 242/598.6
6,145,779 A * 11/2000 Johnson ..... A47K 10/3687 242/564.2
6,152,397 A * 11/2000 Purcell ..... A47K 10/3687 242/563.2
6,224,010 B1 * 5/2001 Morand ..... A47K 10/3687 242/564.2
6,736,348 B1 * 5/2004 Formon ..... A47K 10/3687 242/563
7,354,015 B2 * 4/2008 Byrd ..... A47K 10/36 242/563
7,841,556 B2 * 11/2010 Elliott ..... A47K 10/3687 242/564.2
7,878,444 B2 * 2/2011 Friesen ..... A47K 10/3687 242/561
8,061,198 B2 * 11/2011 Yinko ..... G01F 23/2962 73/290 V
8,282,033 B2 * 10/2012 Achton ..... A47K 10/3687 242/560.1
8,366,035 B2 * 2/2013 Kling ..... B65H 7/04 242/606
8,610,536 B2 * 12/2013 Libby ..... B67D 1/0888 340/541
10,416,306 B2 * 9/2019 Estevez ..... G01N 29/14
10,631,691 B2 * 4/2020 Becker ..... B65H 26/06
12,104,941 B2 * 10/2024 Kobs ..... A47K 5/1202
2006/0032862 A1 * 2/2006 Miller ..... B67D 7/22 222/64
2007/0010389 A1 * 1/2007 Cutrona ..... A47K 10/3643 83/337
2007/0236110 A1 * 10/2007 Kling ..... A47K 10/36 312/34.4
2010/0044407 A1 * 2/2010 Yardley ..... B65H 35/0006 225/14
2010/0268381 A1 10/2010 Goerg et al.
2012/0056774 A1 * 3/2012 Wennerberg ..... G01F 25/20 342/124
2014/0367401 A1 * 12/2014 Stralin ..... A47K 10/38 221/6
2018/0310780 A1 11/2018 Mahaffey et al.
2018/0333013 A1 11/2018 Starkey et al.
2018/0368628 A1 12/2018 Schuh et al.
2024/0260793 A1 * 8/2024 Kuylenstierna ..... A47K 10/426

FOREIGN PATENT DOCUMENTS

CN 1901829 A 1/2007
CN 101080188 A 11/2007
CN 104061958 A 9/2014
JP 2005258523 A 9/2005
WO 2006065514 A1 6/2006

OTHER PUBLICATIONS

Written Opinion for International Application No. PCT/EP2021/063856; International Filing Date: May 25, 2021; Date of Mailing: Feb. 2, 2022; 7 pages.
Chinese Application No. 202180098597.6; Office Action with English translation dated Jul. 30, 2025; 15 pages.
Chinese Notice of Allowance, Application No. 202180098597.6, mailed Dec. 10, 2025, with English Translation, 9 pages.

* cited by examiner

METHOD FOR EVALUATING A STATUS OF A DISPENSER AND A DISPENSER

CROSS REFERENCE TO RELATED APPLICATIONS

This application is a National Stage application of PCT/EP2021/063856, filed May 25, 2021, which is incorporated by reference in its entirety herein.

TECHNICAL FIELD

The present disclosure relates to a method for evaluating a status of a dispenser for dispensing a sheet product for wiping, and to a dispenser for dispensing a sheet product. The disclosure further relates to a computer program, a computer readable medium and a control unit for implementing said method.

BACKGROUND

In public or industrial environments, sheet products for wiping, such as paper or nonwoven sheet products, for example toilet paper, household towels, napkins, towels, or industrial wipes, are often provided to the users in designated sheet product dispensers. The dispensers need regular refill of new sheet products as the products within the dispensers are depleted.

To evaluate the remaining amount of sheet products in a dispenser, level sensors may be arranged in the dispensers, and the information from the level sensors may be used to indicate when refill with new sheet products is necessary.

US 2014/0367401 describes a dispenser having an ultrasonic product level sensor and a system including such a level sensor.

However, in view of the various designs of dispensers and the many alternatives for sheet products, there is still a need for improvement and/or alternatives when it comes to evaluating the status of a dispenser.

SUMMARY

An object of the present invention is to fulfill said need for improvement and/or alternatives.

In a first aspect, there is provided a method for evaluating a status of a dispenser for dispensing a sheet product for wiping, the dispenser defining a storage volume for housing a sheet product supply when the dispenser is in use, the storage volume defining a depletion direction along which the location of a boundary surface of the sheet product supply will vary as the amount of sheet products in the dispenser decreases upon feeding of the sheet products from the sheet product supply, the storage volume extending along the depletion direction at least between a storage volume minimum level corresponding to no sheet product supply in the dispenser, and a storage volume maximum level corresponding to a maximum sheet product supply in the dispenser; and the dispenser comprising a sensor, such as a radar sensor, the sensor being configured to emit a sensor beam;

the method comprising:

Providing a sensor echo signal indicative of a distance from the sensor to the boundary surface, and, when one or more reflective surfaces at least partially reflecting the sensor beam are located between the sensor and the boundary surface, indicative of a distance from the sensor to the reflective surface(s), using said sensor; and Determining the status of the dispenser using the sensor echo signal.

The sheet product for wiping may be e.g. a paper sheet product or a non-woven product. The sheet product may be provided as a continuous web, with or without perforations. Such a continuous web may be provided for example as a folded stack or roll. The sheet product may be separate products, e.g. in the form of individual sheets. For example, such individual sheets may be folded and/or interfolded and arranged in a stack. The sheet product for wiping may for example be industrial wipes, kitchen paper, toilet paper, towels or napkins.

The sensor is a sensor configured to emit a sensor beam being susceptible to being at least partly reflected by the boundary surface. Moreover, the sensor is configured to emit a sensor beam being susceptible to being at least partly reflected by one or more reflective surfaces located between the sensor and the boundary surface, so as to enable the provision of a sensor echo signal indicative of the distance from the sensor to the reflective surfaces.

The reflective surfaces may be spaced along the depletion direction.

The reflective surfaces may have an extension perpendicular to the depletion direction.

The sensor may be configured to emit a sensor beam which is only partially reflected by one or more of the reflective surfaces. Accordingly, a portion of the beam which is not reflected may propagate through a first reflective surface so as to reach a next reflective surface as seen along a propagation direction of the beam, so as to provide a sensor echo signal indicative of the distance from the sensor to one or more reflective surfaces. A portion of the beam may then propagate through the next reflective surface and so on.

The sensor may be configured such that, having passed any one or more reflective surfaces present between the sensor and the boundary surface, a portion of the beam will reach the boundary surface such that the sensor echo signal is indicative of the distance from the sensor to the boundary surface.

The sensor may hence provide a sensor echo signal indicative of the distance from the surface to the boundary surface even when one or more reflective surfaces are located between the sensor and the boundary surface.

The requirements of the sensor may be adapted to the reflective surfaces which the sensor beam is susceptible to encounter in the dispenser.

For example, the sensor may be a radar sensor arranged to emit a radar beam and to sense an echo of the radar beam so as to provide the radar echo signal.

The status to be determined may be a sheet supply status indicating the amount of sheet product in the storage volume of the dispenser. Alternatively or in addition, the status to be determined may be indicating a dispenser error. A dispenser error could for example be a sheet or web breakage inside the dispenser.

Determining the status of the dispenser using the sensor echo signal may involve using the sensor echo signal being indicative of the distance from the surface to the boundary surface and of the distance to the one or more reflective surfaces located between the sensor and the boundary surface. Thus, information regarding not only the boundary surface, but also the reflective surfaces may be used to determine the status of the dispenser.

That the dispenser is in use means herein that it is ready for use, i.e. that it contains a sheet product supply and, if applicable to the particular dispenser, that the sheet product is threaded in the dispenser. That the dispenser is in use does not necessarily mean that the sheet product is continuously moving or actively being fed out from the dispenser.

Optionally, the boundary surface is a surface of the sheet product supply from which sheet product is fed when the dispenser is in use. The use of a sensor providing a sensor echo signal indicative of the distance from the sensor to one or more reflective surfaces at least partially reflecting the sensor beam enables using the boundary surface being the surface from which sheet product supply is fed as a basis for estimation of the dispenser status. This may be particularly advantageous for certain dispenser designs.

Optionally, at least one out of the one or more reflective surfaces is located between the sensor and the boundary surface. The reflective surfaces may be partially reflecting, meaning that the sensor may provide a sensor echo signal indicative of the distance from the sensor to the boundary surface, even though one or more other reflective surfaces may be located between the sensor and the boundary surface.

Optionally, at least one out of the one or more reflective surfaces being located between the sensor and the boundary surface has a surface extension at least partly covering said boundary surface as seen along a propagation direction of the sensor beam.

Optionally, at least one out of the one or more reflective surfaces being located between the sensor and the boundary surface has a surface extension completely covering said boundary surface as seen along a propagation direction of the sensor beam.

Optionally, at least one out of the one or more reflective surfaces is located in the storage volume between the storage volume minimum and the storage volume maximum.

Optionally, at least one of the one or more reflective surfaces may be a static element. With "static" is in this context meant an element which is in the same position relative to the sensor and the storage volume during use of the dispenser.

Optionally, at least one of the one or more reflective surfaces comprises a dispenser element.

Such a dispenser element could be a static element, e.g. a part of the housing of the dispenser, a part of a threading arrangement etc. For example, such a dispenser element may be provided in the dispenser, outside of the storage volume.

Optionally, at least one of the one or more reflective surfaces may be a dynamic element. With "dynamic" is in this context meant an element whose position relative to the sensor and the storage volume may vary during use of the dispenser.

A dispenser element could be a dynamic element, e.g. a part inside the housing of the dispenser which is configured to assume more than one position when the dispenser is in use.

Optionally, at least one of the one or more reflective surfaces is a sheet product element.

Optionally, the sheet product element may be comprising sheet product being fed from the sheet product supply when the dispenser is in use. For example, the sheet product element may be a layer of sheet product.

For example, the sensor may be configured to emit a sensor beam which is only partially reflected by one layer of the sheet product, e.g. by one layer of sheet product as fed from the sheet product supply. Accordingly, if one or more sheet product elements are positioned between the sensor and the boundary surface, at least a portion of the sensor beam may still reach the boundary surface, and the sensor echo signal may be indicative of the distance from the sensor to said sheet product elements, as well as of the distance from the sensor to the boundary surface.

A sheet product element may be a dynamic element, i.e. the position of the sheet product element could vary during use of the dispenser.

The dispenser may define a web path along which the sheet product is fed from the sheet product supply to a dispenser opening when the dispenser is in use. The web path may have an extension such that the sensor echo signal is indicative of the location of one or more sheet product elements along the web path, when the dispenser is in use.

For example, the web path may extend at least partly through the storage volume, between the storage volume minimum and maximum.

Optionally, the web path may be constant, i.e. the web path has essentially the same extension inside the dispenser regardless of the location of the boundary surface of the sheet product supply.

Optionally, the web path may be varying, i.e. the web path follows a number of different possible extensions inside the dispenser depending e.g. on the location of the boundary surface of the sheet product supply.

Optionally, the step of determining the status of the dispenser comprises identifying the boundary surface using the sensor echo signal. For example, the step of identifying the boundary surface may comprise identifying the boundary surface out of the one or more surfaces of which the sensor echo signal is indicative. For example, this may be the case when the sensor echo signal is indicative of at least one reflective surface in addition to the boundary surface.

Optionally, the sensor echo signal indicates a sensor signal amplitude, and the step of determining the status of the dispenser comprises determining the status based on the sensor signal amplitude.

For example, the step of identifying the boundary surface may comprise using the amplitude of the sensor echo signal. For example, a step of determining the location of the boundary surface in the storage volume may comprise identifying an amplitude maximum using the sensor signal amplitude.

For example, a step of identifying any reflective surfaces may comprise identifying amplitude maxima using the sensor signal amplitude.

Optionally, the step of determining the status of the dispenser comprises determining the location of the boundary surface along the depletion direction between the storage volume maximum level and the storage volume minimum level in the storage volume.

Optionally, the step of determining the status of the dispenser comprises comparing the sensor echo signal to one or more reference sensor echo signals.

For example, the step of identifying the boundary surface may be made using comparison of the sensor echo signal to one or more reference sensor echo signals.

For example, the step of determining the status of the dispenser may be made solely by comparing the sensor echo signal to one or more reference sensor echo signals.

Optionally, the one or more reference sensor echo signals comprises an empty dispenser reference signal retrieved from a dispenser with no sheet product supply therein.

For example, the empty dispenser reference signal may be used to filter away information from the sensor echo signal which relates to the dispenser rather than to the sheet product supply.

For example, information regarding static elements, e.g. dispenser elements, located the sensor and the boundary surface of the web supply may be filtered away using an empty dispenser reference signal.

Optionally, the step of determining the status of the dispenser may comprise comparing the sensor echo signal with an empty dispenser reference signal so as to form a calibrated sensor echo signal, and to continue the evaluation based on said calibrated sensor echo signal.

Optionally, the one or more reference sensor echo signals comprises one or more reference signals corresponding to a predetermined status of the dispenser.

Thus, for reference, it may be selected to measure and store the sensor echo signal obtained when the dispenser comprises different amounts of sheet product supply, i.e. corresponding to different statuses.

Optionally, the sheet status may be one out of a number of predetermined statuses.

For example, the one or more reference signals corresponding to a status of the dispenser corresponds to a ready for refill status, a sufficiently filled status and/or a close to depleted status.

Reference signals as referred to herein may be measured and stored by using the sensor for measuring on the dispenser per se at different statuses. Alternatively, reference signals may be obtained from measurements on a sample dispenser of identical design as the dispenser. Thus, reference signals obtained from a sample dispenser may be used for several dispensers of identical design.

By comparing a present sensor echo signal with reference sensor echo signals, the status of the present sheet product supply may be determined.

Optionally, the storage volume is divided along the depletion direction by one or more thresholds, and the step of determining the status of the dispenser comprises determining whether the location of the boundary surface is above or below the one or more thresholds, using the sensor echo signal.

Optionally, the method comprises that one of the one or more thresholds is a refill threshold and, upon determining that the location of the boundary surface is above the refill threshold as seen along the depletion direction, determining that the status of the dispenser is to be ready for refill; and/or wherein one of the one or more thresholds is a fill threshold, and, upon determining that the location of the boundary surface is below the fill threshold as seen along the depletion direction, determining that the status of the dispenser is sufficiently filled; and/or wherein one of the one or more thresholds is a depleted threshold, and, upon determining that the location of the boundary surface is above the depleted threshold, as seen along the depletion direction, determining that the status of the dispenser is close to be depleted.

For example, the refill threshold may be set at a distance from the storage volume minimum level indicating that refill of the dispenser is suitable.

For example, the fill threshold may be set at a level where there is no need for refill, or alternatively where no refill is possible, such as when there is no room for a refill supply to be introduced in the storage volume.

Optionally, the fill threshold may equal the refill threshold—i.e. the evaluation will select between a refill status and a sufficiently filled status, using one single threshold level.

For example, a close-to-depleted threshold may be set for a level where only a small amount of sheet product is left in the dispenser, indicating a more urgent need for refill.

Thresholds may be set with varying intervals along the depletion direction, between the minimum storage level and the maximum storage level, depending on their intended use.

Optionally, thresholds may be set with incremental steps along the depletion direction, between the minimum storage level and the maximum storage level, so as to enable determination of incremental statuses.

Optionally, the status may be continuously indicative of the location of the boundary surface in the storage volume. For example, the sheet status may simply be the present distance of the boundary surface from the minimum or maximum storage level in the dispenser, expressed e.g. as a length unit or as in terms of a part of the entire length between the minimum and maximum level.

Optionally, the method may further comprise

Issuing a signal indicative of the status.

Optionally, the step of issuing a signal indicative of the status may be performed upon determining an altered status as compared to a previous status.

Optionally, the step of issuing a signal indicative of the status may be performed at regular intervals.

Optionally, the step of issuing a signal indicative of the status may be performed upon request.

A signal indicative of the status may be transferred wirelessly or by wire e.g. to a processing unit.

In a second aspect, there is provided a control unit being configured to perform the steps of the method according to any one of the previous claims.

In a third aspect, there is provided a computer program comprising program code means for performing the steps of the method of the first aspect when the program is run on a computer.

In a fourth aspect, there is provided a computer readable medium carrying a computer program comprising program code means for performing the steps of the method according to the first aspect when the program is run on a computer.

In a fifth aspect, there is provided a dispenser for dispensing a sheet product for wiping, the dispenser defining a storage volume for housing a sheet product supply when the dispenser is in use, the storage volume defining a depletion direction along which the location of a boundary surface of the sheet product supply varies as the amount of sheet product in the storage volume decreases upon feeding of the sheet product from the sheet product supply, the storage volume extending along the depletion direction at least from a storage volume maximum level corresponding to a maximum sheet product supply in the dispenser to a storage volume minimum level corresponding to no sheet product supply in the dispenser, and the dispenser comprising a sensor, such as a radar sensor; the sensor being configured to emit a sensor beam and being arranged to provide a sensor echo signal indicative of a distance from the sensor to the boundary surface, and, when one or more reflective surfaces at least partially reflecting said sensor beam are located between said sensor and said boundary surface, indicative of a distance from said sensor to the reflective surface(s), so as to enable determination of a status of said dispenser.

The sensor may be arranged to provide a sensor echo signal from at least a portion of the storage volume, the portion extending along the depletion direction. The portion of the storage volume may be a portion selected to enable determination of a sheet status of the dispenser.

Optionally, the sensor is arranged to provide a sensor echo signal from the storage volume indicative of the distance from the sensor to the boundary surface for all possible locations of the boundary surface from the storage volume minimum level to the storage volume maximum level.

Optionally, the boundary surface is a surface of the sheet product supply from which sheet product is fed when the dispenser is in use.

Optionally, for at least one possible location of the boundary surface in the storage volume, at least one out of the one or more reflective surfaces is located between the sensor and the boundary surface, when the dispenser is in use.

Optionally, for at least one possible location of the boundary surface in the storage volume, at least one out of the one or more reflective surfaces is located in the storage volume between the storage volume minimum level and the storage volume maximum level, when the dispenser is in use.

Optionally, at least one of the one or more reflective surfaces comprises a dispenser element.

Optionally, at least one of the one or more reflective surfaces is a sheet product element comprising sheet product being fed from the sheet product supply when the dispenser is in use.

Optionally, at least one of the one or more regions comprises a web path along which sheet product is fed from the sheet product supply when the dispenser is in use.

Optionally, for at least one possible location of the boundary surface in the storage volume, the web path extends between the sensor and the boundary surface.

Optionally, the web path may be constant, i.e. the web path has essentially the same extension inside the dispenser regardless of the location of the boundary surface of the sheet product supply.

Optionally, the web path may be varying, i.e. the web path follows a number of different possible extensions inside the dispenser depending e.g. on the location of the boundary surface of the sheet product supply.

In some dispensers, the extension of the web path may vary depending on the location of the boundary surface of the sheet product supply. For example, the web path may extend between the sensor and the boundary surface for a majority of the possible locations of the boundary surface, or for all of the possible locations of the boundary surface.

Optionally, the dispenser comprises a dispensing opening and the web path is a path in the dispenser along which the sheet product is fed from the sheet product supply when present in the storage volume to the dispensing opening.

Optionally, the sensor is arranged such that a propagation direction of the sensor beam has a positive component direction along the depletion direction, preferably the propagation direction is generally parallel to the depletion direction.

A sensor will, as set out in the above, emit a sensor beam and receive an echo of the sensor beam. With propagation direction in the above is meant the propagation direction of the emitted sensor beam. When the beam is reflected to form the sensor echo signal, the propagation direction of the beam is reversed, i.e. back towards the sensor.

Optionally, the storage volume is configured to contain a sheet product supply in the form of a stack of sheet product.

Optionally, the boundary surface is an upper boundary surface of the stack, as seen along a vertical direction when the dispenser is in a use position.

Optionally, the depletion direction may be generally parallel to a vertical direction when the dispenser is in a use position.

Optionally, the upper boundary surface may extend in a generally horizontal plane.

Optionally, the storage volume is configured to contain a sheet product supply in the form of a roll of sheet product.

Optionally, the boundary surface is a radially exterior surface of the roll.

Optionally, the boundary surface is a radially interior surface of the roll.

In a sixth aspect, there is provided a system for evaluating a status of a dispenser for dispensing a sheet product for wiping, the system comprising a dispenser according to the fifth aspect and a control unit according to the second aspect in the above.

The control unit may be provided with the sensor, and hence arranged as a unit together with the sensor at the dispenser.

Alternatively, the control unit may be provided remote from the sensor and being wirelessly or wiredly connected to the sensor.

In a seventh aspect, there is provided a monitoring system comprising one or more systems according to the sixth aspect, wherein the one or more systems are configured to report a determined status to a local processing unit or to an external processing unit.

Alternatively, there is provided a monitoring system comprising one or more dispensers according to the fifth aspect, wherein the sensors of the one or more dispensers are configured to report the sensor echo signal to a local processing unit or to an external processing unit for determination of the status.

Features and advantages as described herein in relation to any one of the aspects of the disclosure are equally applicable to the other aspects of the disclosure.

Further advantages and advantageous features of the invention are disclosed in the following description and in the dependent claims.

BRIEF DESCRIPTION OF THE DRAWINGS

With reference to the appended drawings, below follows a more detailed description of embodiments of the invention cited as examples.

In the drawings.

DETAILED DESCRIPTION

Figure 1:
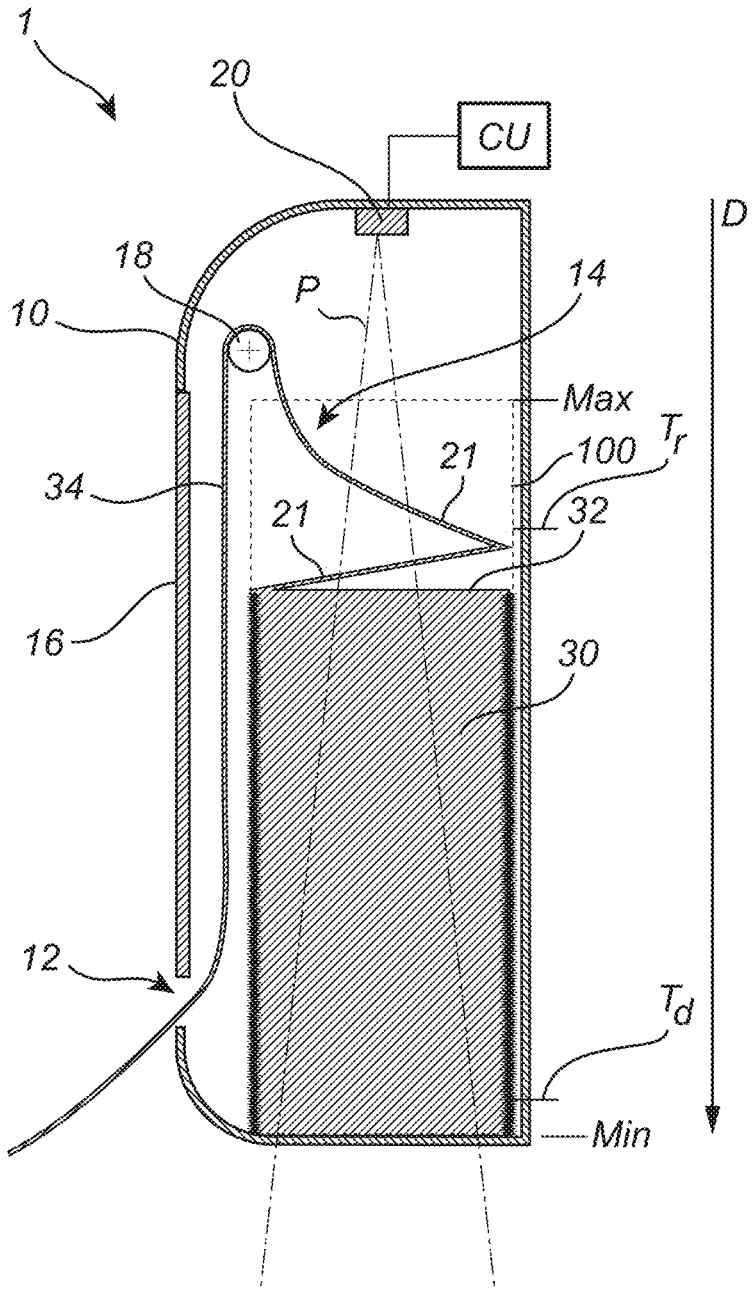
FIG. 1 illustrates schematically a first variant of a dispenser for a sheet product.

FIG. 1 illustrates an example of a dispenser 1 for dispensing a sheet product for wiping. The dispenser 1 defines a storage volume 100 for housing a sheet product supply 30 when the dispenser 1 is in use. The storage volume 100 defines a depletion direction D along which the location of a boundary surface 32 of the sheet product supply 30 varies as the amount of sheet product in the storage volume 100 decreases upon feeding of the sheet product 34 from the sheet product supply 30. The storage volume 100 extends along the depletion direction D at least between a storage volume maximum level Max corresponding to a maximum sheet product supply 30 in the dispenser 1, and a storage volume minimum level Min corresponding to no sheet product supply in the dispenser 1.

In FIG. 1, the example dispenser 1 is illustrated with a sheet product supply 30 having a boundary surface 32 located between the storage volume minimum level Min and maximum level Max, i.e. the storage volume 100 is neither empty nor completely filled.

The dispenser 1 further comprises a sensor 20 configured to emit a sensor beam to provide a sensor echo signal indicative of the distance from the sensor 20 to one or more reflective surfaces 21 at least partially reflecting the sensor beam, wherein one of the one or more reflective surfaces 21 is the boundary surface 32.

The sensor may be a sensor suitable to provide a sensor echo signal as required for the application in the dispenser. The sensor may be a radar sensor emitting a radar beam and providing a radar echo signal. For example, the radar sensor may be a sensor as provided by Acconeer. In particular, Acconeer sensors XM122/XB122 are believed to be suitable for the application in a dispenser, and have been used for the exemplary embodiments.

For example, the sensor may be provided with a hyperbolic lens.

For example, the sensor may be a sensor providing 60 Ghz pulsed coherent radar (PCR). This has been found to be useful for application in a dispenser for a sheet product.

Generally, the sensor may be configured to be suitable for the dispenser and for the sheet product to be used in the dispenser. For example, in a dispenser where the sheet product is fed from the boundary surface, one or more layers of sheet product may at least sometimes during use of the dispenser be present between the sensor and the boundary surface, forming one or more reflective surfaces. Accordingly, the sensor may be configured so as to enable the provision of a sensor echo signal being indicative of the boundary surface and of the one or more reflective surfaces. To this end, the sensor may be adapted to the properties of the sheet product, e.g. its thickness, surface roughness, or composition. Further, the sensor may be adapted to the configuration of the dispenser.

As illustrated in FIG. 1, the sensor 20 may be arranged to provide a sensor echo signal from the storage volume 100 indicative of the distance from the sensor 20 to the boundary surface 32 for all possible locations of the boundary surface 32 between storage volume minimum level Min to the storage volume maximum level Max. To this end, in the illustrated embodiment, the sensor 20 is arranged such that the propagation direction (P) of the emitted sensor beam is generally parallel to the depletion direction D.

When the sensor is configured to indicate the distance to the boundary surface 32 for all possible locations between the storage volume minimum level Min to the storage volume maximum level Max, information regarding the location of the boundary surface 32 over the entire supply volume 100 may be available for the determination of the status.

However, in some variants, it may be sufficient that the distance to the boundary surface 32 in a portion of the dispenser 100 is detectable, for example in a portion selected to be relevant to determine a status of the dispenser. For example, if only a refill status is to be determined, it may be sufficient to determine the distance to the boundary surface 32 in a portion of the dispenser 100 adjacent to a refill threshold. Thus, optionally, the sensor may be configured to indicate the distance to the boundary surface 32 for at least a portion of the storage volume 100 extending along the depletion direction D.

As illustrated in FIG. 1, the boundary surface 32 is a surface of the sheet product supply 30 from which sheet product is fed when the dispenser 1 is in use. When the boundary surface 32 is a surface from which sheet product is fed, it is likely that the sheet product being fed from the sheet supply 30 will be present at a location between the sensor 20 and the boundary surface 32 to be detected, when the dispenser is in use.

As may be seen in FIG. 1, in this example, the dispenser 1 comprises a web path 14 along which sheet product 34 is fed from the sheet product supply 30 when the dispenser is in use.

As in the illustrated dispenser 1, the dispenser may comprise a dispensing opening 12, and the web path 14 is a path along which the sheet product 34 is fed from the sheet product supply 30 to the dispensing opening 12.

As illustrated in the example of FIG. 1, the boundary surface 32 of the web supply 30 may be an upper surface as seen in a generally vertical direction. The web path 14 may initially extend upwards from the boundary surface 32 of the web supply 30.

As illustrated in FIG. 1, the web path 14 may extend between the sensor 20 and the boundary surface 32, i.e. so as to cross the propagation direction of the sensor beam. Hence, when the dispenser 1 is in use, one or more layers of sheet product 34 may be located between the sensor 20 and the boundary surface 32.

The sheet product 34 may thus form reflective surfaces 21 at least partially reflecting the sensor beam, and being located between the sensor 20 and the boundary surface 32 when the dispenser is in use. Accordingly, the sensor echo signal provided by the sensor 20 may be indicative of the distance from the sensor 20 to the reflective surfaces 21 of the sheet product 34 and of the distance from the sensor 20 to the boundary surface 32.

Further, as also exemplified in claim 1, at least one of the one or more reflective surfaces 21 may be located in the storage volume 100, between the storage volume minimum (min) and the storage volume maximum (max), when the dispenser is in use.

As may be gleaned from FIG. 1, the web path 14 along which the sheet product 34 extends may vary depending on the location of the boundary surface 32 between the storage volume minimum level (Min) and storage volume maximum level (Max). Hence, the number of layers, i.e. the number of reflective surfaces 21, formed between the boundary surface 32 and the sensor 20 by the sheet product 34 may vary during depletion of the dispenser 1.

In the illustrated example, the storage volume 100 is configured to house a sheet product supply 30 in the form of a stack, for example a stack of towels, such as paper handtowels.

The boundary surface 32 may be an upper boundary surface of the stack, as seen along a vertical direction when the dispenser 1 is in a use position. The boundary surface 32 may extend in a generally horizontal plane.

As illustrated in FIG. 1, the vertical direction may be parallel to the depletion direction.

Further, the dispenser may, as illustrated in FIG. 1, comprise a housing 10 enclosing the storage volume 100 and optionally other dispenser elements, e.g. intended for feeding the sheet product.

The housing 10 may comprise an openable and closable door 16 for filling sheet product to the dispenser 1.

The dispenser 1 may be configured for refill of sheet products from a bottom end of the dispenser 1. The refill may be connected to the sheet product supply 30 already present in the dispenser to form a new sheet product supply 30. Accordingly, sheet product 34, e.g. in the form of a web, may remain threaded e.g. along a web path 14 to the dispensing opening 12 during refill.

The sensor echo signal may be provided also during refill of the dispenser, and the status of the dispenser may be determined. Accordingly, the status of the dispenser may be evaluated not only during depletion of the dispenser but also during refill of the dispenser.

As illustrated in FIG. 1, the dispenser 1 may form part of a system comprising the dispenser 1 and a control unit CU, wherein the control unit CU is configured to perform a method for evaluating the sheet product supply of the dispenser as will be described in the following.

The control unit CU may be provided together with the sensor 20, i.e. the sensor 20 and CU forms a unit. Alternatively, the sensor 20 may be connected to the control unit CU by wired or wireless connection.

Further, there may be provided a monitoring system comprising one or more systems comprising a dispenser 1 and a control unit CU. The systems may be configured to report determined status of the dispensers of the monitoring system to a local processing unit or to an external processing unit. The monitoring system may be configured to signal the determined status of the dispenser—e.g. a ready to refill status or a dispenser error status—to staff thus being prompted to e.g. replenish the dispenser or remove the error.

Figure 2:
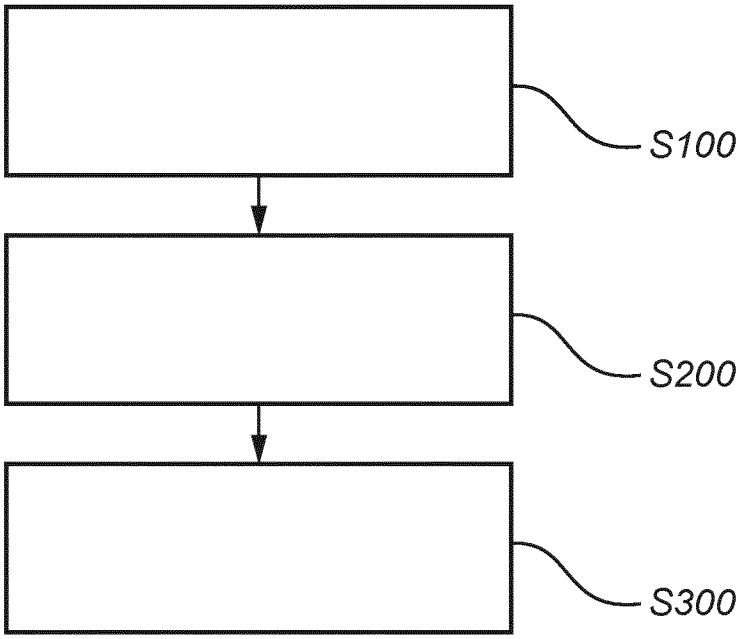
FIG. 2 is a flow chart illustrating a method for evaluating the status of a dispenser.

FIG. 2 is a flow chart schematically illustrating a variant of a method for evaluating a status of a dispenser. The description in the below will be made with reference to the dispenser 1 of FIG. 1. However, it is to be understood that the method is not limited to the exemplary dispenser only but may be used with a wide range of dispensers.

The method comprises:

Providing a sensor echo signal indicative of a distance from said sensor 20 to said boundary surface 32, and, when one or more reflective surfaces 21 at least partially reflecting said sensor beam are located between said sensor 20 and said boundary surface 32, indicative of a distance from said sensor 20 to said reflective surface(s) 21, using said sensor 20, S100; and Determining a status of said dispenser 10 using said sensor echo signal S200.

The method illustrated in FIG. 2 further illustrates the optional step of issuing a signal indicative of the status S300.

Such a signal may be issued for example at regular time intervals. Alternatively or in addition, such a signal may be issued upon determining an altered status as compared to a previous status. Alternatively or in addition, such signal may be issued upon request.

The signal indicative of the status may be transferred by wired or wireless connection for example to a local processing unit or to an external processing unit.

The method thus encompasses that the sensor echo signal may be indicative of the distance to reflective surfaces 21 in addition to the boundary surface 32. For example, this may occur when the boundary surface 32 is a surface from which sheet product is fed, since this at least in some dispenser configurations implies that sheet product being fed from the supply 30 may be present between the sensor 20 and the boundary surface 32.

In the example of FIG. 1, two reflective surfaces 21, both being constituted by sheet product 34 is seen between the boundary surface 32 and the sensor 20.

FIGS. 3*a* to 3*d* are examples of sensor echo signals retrieved from a dispenser of a similar type as the dispenser 1 in FIG. 1. The sensor echo signals show the amplitude of the sensor echo signal along the vertical axis vs the distance from the sensor 20 along the horizontal axis.

Max indicates the storage volume maximum volume level and Min the storage volume minimum level.

Figure 3A:
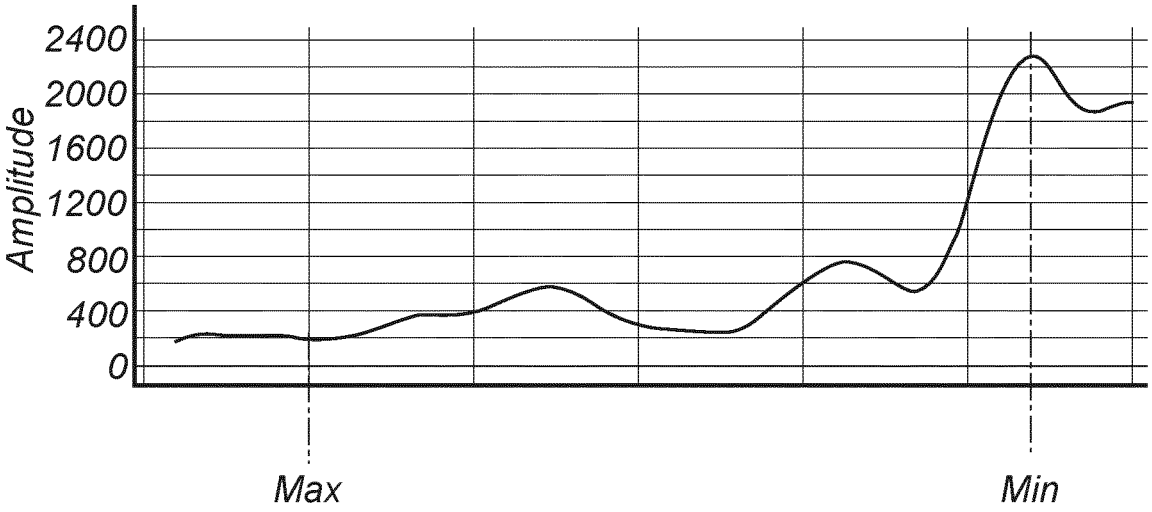
FIGS. 3*a* to 3*d* are examples of sensor echo signals from a sensor in a dispenser as illustrated in FIG. 1.

The examples of sensor echo signals were retrieved using an Acconeer sensor as mentioned in the above, arranged in a Tork Peak Serve® dispenser. The sheet product was Tork Peak Serve® Continuous®, article no 100585 as provided by essity. FIG. 3*a* is a sensor echo signal diagram retrieved when the dispenser 1 is empty, i.e. when there is no sheet product supply in the dispenser. An amplitude maximum at the storage volume minimum level may for example indicate the presence of a floor or support members for the sheet material supply 30 in the dispenser.

Figure 3B:
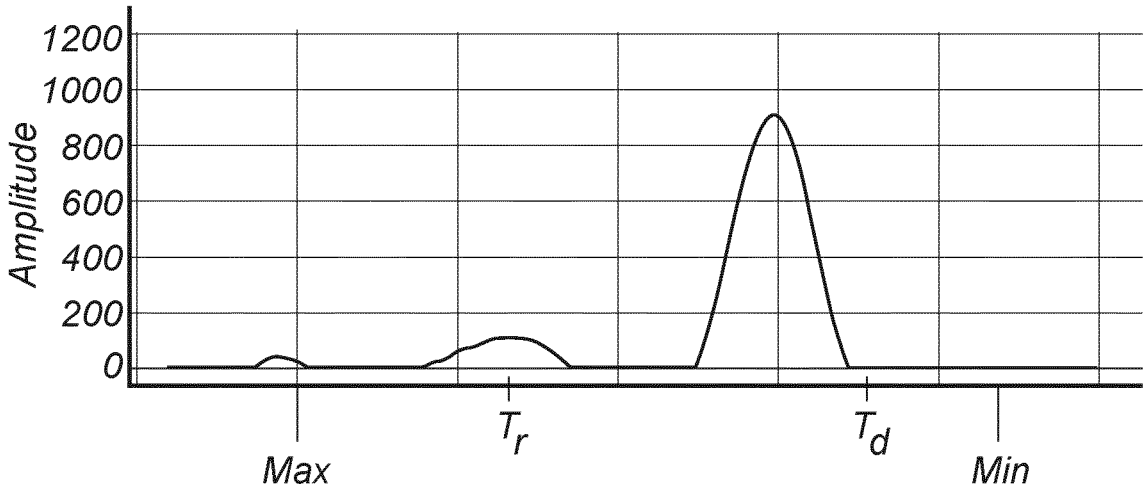
Figure 3C:
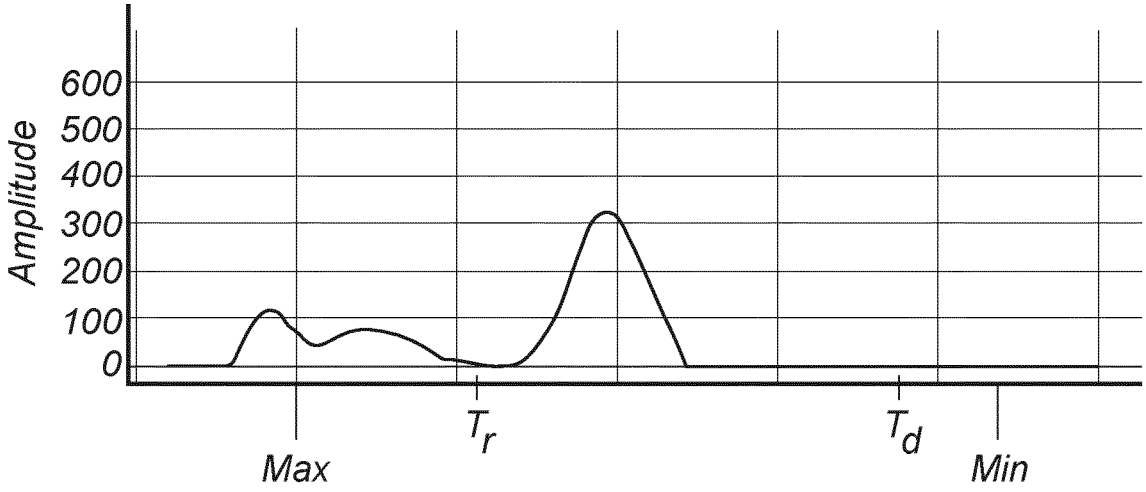
Figure 3D:
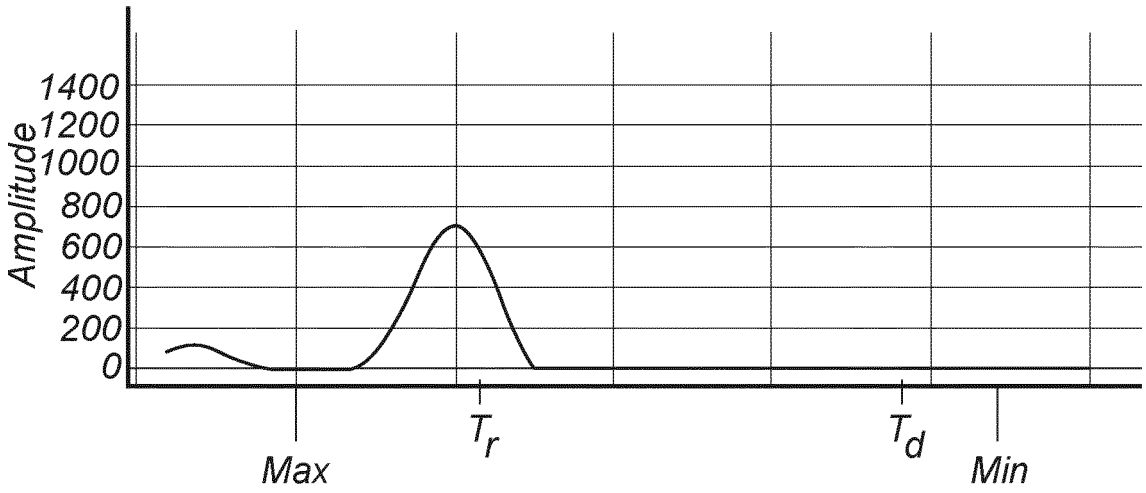

The sensor echo signal diagram of FIG. 3*a* is used as a filter for the sensor echo signal diagrams of FIGS. 3*b* to 3*d*. Accordingly, the reflective surfaces detected in the empty dispenser as indicated by the varying amplitudes in FIG. 3*a* are removed from the sensor echo signal diagrams of FIGS. 3*b* to 3*d*. Thus, the amplitude-distance curves of FIGS. 3*b* to 3*d* are indicative of reflective surfaces in the dispenser 1 other than those comprising static dispenser elements. FIGS. 3*b* to 3*d* are hence examples of a calibrated sensor echo signal, which is achieved by comparing the sensor echo signal to an empty dispenser reference sensor echo signal. The continued analysis of the sensor echo signal may be based on the calibrated sensor echo signals.

FIG. 3*b* is a calibrated sensor echo signal diagram retrieved when the dispenser 1 is filled with a first amount of sheet product. In this case, the first amount of sheet product corresponds to a refill stack being introduced in the dispenser, and hence the sheet material supply 30 has the size of one such refill stack. The largest amplitude maximum seen to the right in FIG. 3*b* corresponds to the location of the boundary surface 32 of the sheet product supply 30 in the storage volume 100. The two smaller amplitude maxima to the left in FIG. 3*b* may correspond to the location of other reflective surfaces 21, such as sheet product layers of sheet product 34 being fed from the sheet supply 30.

FIG. 3*c* is similar to FIG. 3*b*, but the calibrated sensor echo signal diagram is retrieved when the dispenser is filed with a second amount of sheet product. In this case, the second amount of sheet product corresponds to two refill stacks being present in the dispenser 1, and hence the sheet material supply 30 has the size of two such refill stacks. As compared to FIG. 3*b*, it may be seen how the largest amplitude maximum seen to the right in FIG. 3*c* is moved further towards the storage volume maximum level Max. Again, there are two smaller amplitude maxima to the left in FIG. 3*c*, which may correspond to the location of other reflective surfaces 21.

FIG. 3*d* is similar to FIGS. 3*b* and 3*c*, but the calibrated sensor echo signal diagram is retrieved when the dispenser is filled with a third amount of sheet product. In this case, the third amount of sheet product corresponds to three refill stacks being present in the dispenser 1, and hence the sheet material supply 30 has the size of three such refill stacks. As compared to FIG. 3*c*, it may be seen how the largest amplitude maximum in FIG. 3*d* is moved yet further towards the storage volume maximum level Max. In this example image, only one smaller amplitude maximum is shown to the left in FIG. 3*d*, and outside of the range between the storage volume minimum level Min and the storage volume maximum level Max. Again, the smaller amplitude maxima may correspond to the location of another reflective surface 21, such as a surface from sheet product being fed inside the dispenser.

As may be gleaned from FIGS. 3*a* to 3*d*, the distance between the sensor 20 and the boundary surface 32 (i.e. the location of the boundary surface 32 in the storage volume 100) may be detectable from the sensor echo signal, although at least one reflective surface is located between the sensor 20 and the boundary surface 32.

In the illustrated examples, there are one or more reflective surfaces 21 constituted by sheet product being fed from the sheet product supply 30 when the dispenser is in use.

That the dispenser is in use means in this context that it is ready for use, i.e. that it contains a sheet product supply and, if applicable to the particular dispenser, that the sheet product is threaded in the dispenser. That the dispenser is in use does not necessarily mean that the sheet product is continuously moving or actively being fed out from the dispenser.

The step of determining the status of the dispenser may comprise identifying the boundary surface using the sensor echo signal. For example, identification may be made by comparison with a reference signal or signals, by removal of information in the sensor echo signal outside of the storage volume minimum and maximum range, and/or by evaluating the amplitudes and locations of amplitude maxima in the sensor echo signal and/or by other options.

For example, the sensor echo signal indicates a sensor signal amplitude, and the step of determining the status of the dispenser comprises determining the status based on the amplitude.

For example, the step of determining the status of the dispenser comprises determining the location of the boundary surface 32 along the depletion direction D between the maximum storage level Max and the minimum storage level Min in the storage volume 100.

Optionally, the storage volume 100 may be divided along the depletion direction D by one or more thresholds, and the step S200 of determining the status of the dispenser 1 comprises determining whether the location of the boundary surface 32 is above or below the one or more thresholds, using the sensor echo signal.

As in the example referring to FIGS. 1 and 3*a* to 3*d*, one of the one or more thresholds may be a refill threshold Tr and, upon determining that the location of the boundary surface is above the refill threshold Tr as seen along the depletion direction D, the method comprises determining that the status of the dispenser is to be ready for refill. For example, when the dispenser is to be refilled with refill stacks having a fixed size, the refill threshold Tr may be set at a distance of one refill stack from the storage volume maximum level Max. Hence, when the status is set to "ready for refill", this indicates that at least one refill stack may be introduced in the dispenser. In other alternative, the refill threshold Tr may be set at a distance from the volume maximum level Max at which it is deemed suitable to refill the dispenser.

Alternatively or in addition, one of the one or more thresholds may be a depleted threshold Td as illustrated in FIGS. 1, 3*a* to 3*d*. Upon determining that the location of the boundary surface 32 is above the depleted threshold Td, as seen along the depletion direction D, it may be determined that the status of the dispenser is close to be depleted. The depleted threshold Td may hence be set at a distance from the volume minimum level Min corresponding to a relatively small amount of sheet product.

Alternatively or in addition, other thresholds may be defined, for example, one of the one or more thresholds may be a fill threshold, and, upon determining that the location of the boundary surface 32 is below the fill threshold as seen along the depletion direction D, determining that the status of the dispenser is sufficiently filled.

In the example illustrated in FIG. 1, a refill threshold Tr and a depleted threshold Td are indicated. In this example, the thresholds are determined by their function, i.e. to correspond to a selected predetermined status.

However, thresholds may also be incremental. For example, the storage volume may be divided between the maximum storage level Max and minimum storage level Min by a number of equal increments, such that step-wise statuses may be determined.

Further, when the location of the boundary surface 32 is determined, the status may be reported as the location of the boundary surface 32 in the storage volume 100.

The status may be continuously indicative of the location of the boundary surface 32 in the storage volume 100.

As mentioned in the above step of determining the status of the dispenser may comprise comparing the sensor echo signal to one or more reference sensor echo signals.

The one or more reference sensor echo signals may comprise an empty dispenser reference signal retrieved from a dispenser with no sheet product supply therein.

As explained with reference to FIGS. 3*a* to 3*d* in the above, an empty dispenser reference signal may be used as a filter to provide calibrated sensor echo signals, from which in turn e.g the boundary surface 32 may be identified and/or the location of the boundary surface 32 may be determined. In a dispenser where no static dispenser element is present between the sensor 20 and the boundary surface 32, such as the dispenser illustrated in FIG. 1 (where the sheet product 34 is fed over a roller 18, which as illustrated in FIG. 1 is out of the way of the beam from the sensor 20), the comparison with an empty dispenser reference signal to provide a calibrated sensor echo signal is still relevant, since also other dispenser elements, such as a floor or wall, may contribute to the sensor echo signal. In variants where indeed a static dispenser element (such as the roller 18) is present between the sensor 20 and the boundary surface 32, the impact of such a static dispenser element may be removed from a sensor echo signal by filtering the signal using an empty dispenser reference signal so as to provide a calibrated reference signal for further evaluation.

However, by comparing a sensor echo signal to one or more reference sensor echo signals, determination of a status may be made in various manners.

For example, determining that the status is empty may be made by comparing a present sensor echo signal with a reference sensor echo signal from an empty sensor.

Optionally, the one or more reference sensor echo signals comprises one or more reference signals corresponding to a predetermined status of the dispenser.

For example, by comparing a present sensor echo signal to one or more reference signals corresponding to a ready to refill status, a sufficiently filled status and/or a close to depleted status, determination of the present status of the dispenser may be made.

The method may further comprise issuing a signal indicative of the status. The signal may be issued wirelessly or by wire. The signal may be issued to a local server associated with the dispenser, or it may be issued to a remote server.

Figure 4:
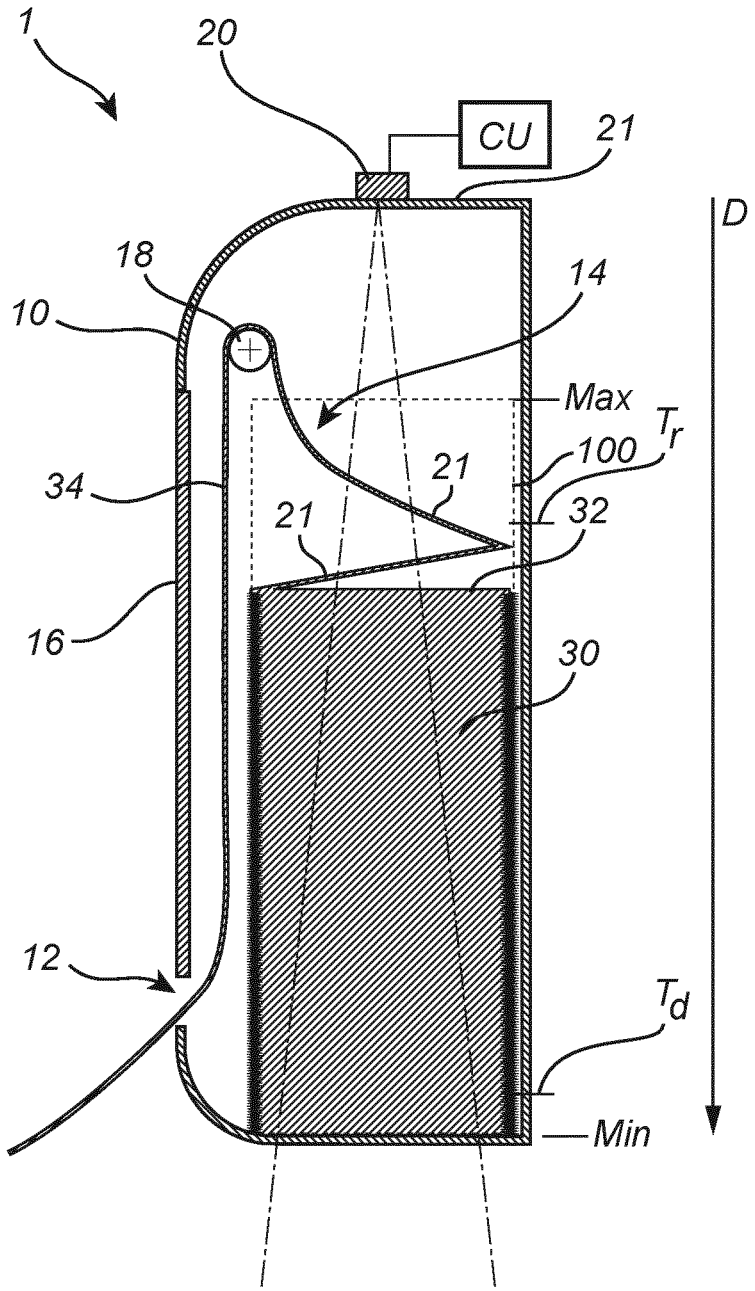
FIG. 4 illustrates schematically a second variant of a dispenser.

FIG. 4 illustrates another example of a dispenser. The dispenser 1 is similar to that of FIG. 1, apart from the positioning of the sensor 20. In the dispenser of FIG. 4, the sensor 20 is positioned outside of the dispenser housing 10.

Accordingly, in addition to the boundary surface 32 and the layers of sheet product 34, which form the reflective surfaces 21 in the dispenser of FIG. 1, the sensor echo signal may be indicative of a reflective surface 21 constituted by a part of the housing 10.

In such a dispenser, the method for evaluating a status may be performed, wherein at least one of the one or more reflective surfaces 21 comprises a dispenser element.

The impact of a dispenser element being static, i.e. fixed in position relative to the sensor 20, may for example be removed by filtering the sensor echo signal using an empty dispenser reference signal as described in relation to FIGS. 3*a* to 3*d*.

Figure 5:
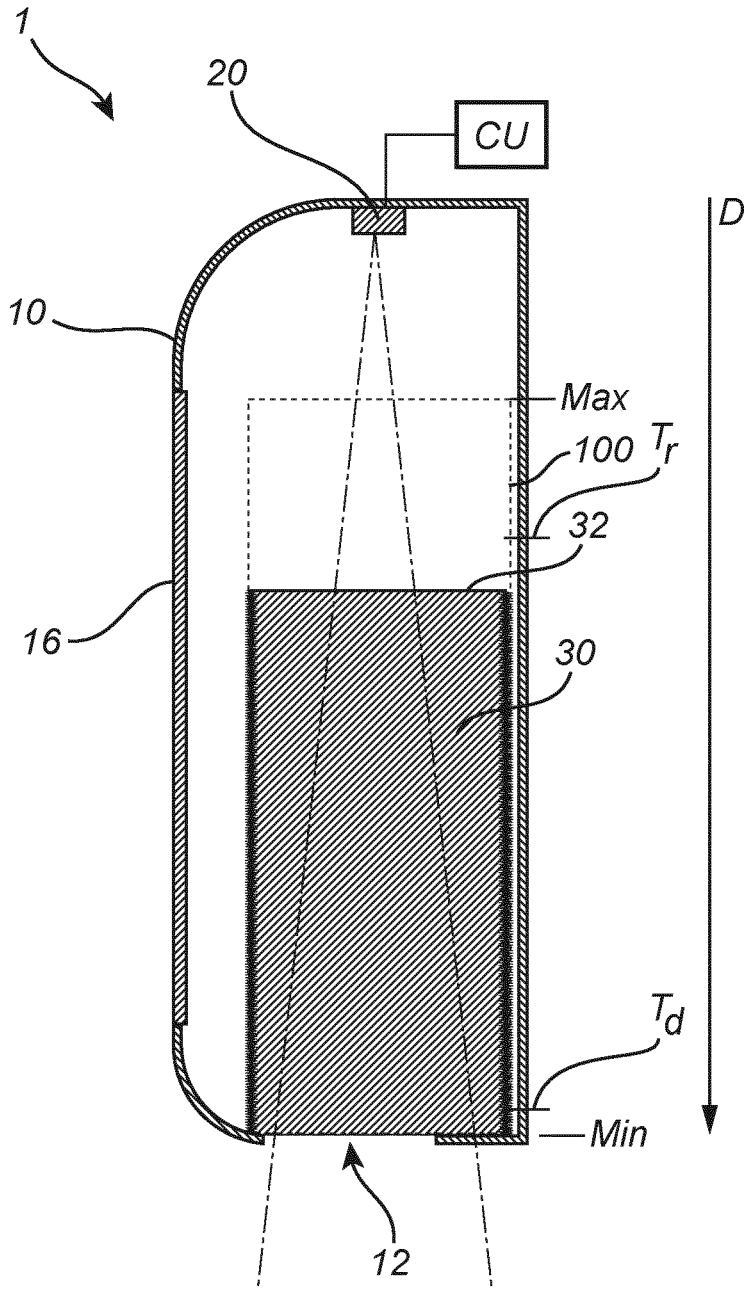
FIG. 5 illustrates schematically a third variant of a dispenser.

FIG. 5 illustrates yet another example of a dispenser. This dispenser differs from the dispensers of FIGS. 1 and 4 in that the dispenser opening 12 is located at the bottom of the dispenser. The sheet product is to be fed out through the dispenser opening 12 from the bottom of the sheet product supply 30 in the form of a stack located in the storage volume 100. A sensor is arranged to detect a boundary surface 32 of the sheet product supply 30 at the top of the sheet product supply 30. Top and bottom refer to the vertical direction in FIG. 5.

Although in this example the boundary surface 32 is not a surface from which sheet product is being fed, the use of a sensor configured to provide a sensor echo signal being indicative of a distance from said sensor to one or more reflective surfaces 21 may still be advantageous if compared to sensor enabling detection of one surface only. For example, errors such as erroneous positioning of the stack in the dispenser, a faulty stack or tampering with the dispenser may be detected, e.g. to indicate that the dispenser status is faulty.

Although the exemplified dispensers are configured to contain a sheet product supply in the form of a stack, other alternatives are available. For example, the storage volume 100 may be configured to contain a sheet product supply 30 in the form of a roll of sheet product.

For example, the boundary surface may be a radially exterior surface of the roll.

In another example, the boundary surface may be radially interior surface of the roll.

In both cases, the boundary surface of the roll may be a surface from which sheet product is fed when the dispenser is in use.

The roll of sheet product may for example be a coreless, centrefeed roll.

In another example, the roll of sheet product may be a roll fed from the perimeter of the roll, with or without core.

It is to be understood that the present invention is not limited to the embodiments described above and illustrated in the drawings; rather, the skilled person will recognize that many changes and modifications may be made within the scope of the appended claims.

The invention claimed is:

1. A method for evaluating a status of a dispenser for dispensing a sheet product for wiping, said dispenser defining a storage volume for housing a sheet product supply when said dispenser is in use, said storage volume extending along said depletion direction at least from a storage volume maximum level (Max) corresponding to a maximum sheet product supply in said dispenser to a storage volume minimum level (Min) corresponding to no sheet product supply in said dispenser, defining a depletion direction along which a distance between a boundary surface of said sheet product supply and the volume maximum level (Max) will vary as an amount of sheet products in said dispenser decreases upon feeding of said sheet products from said sheet product supply, wherein a location of said boundary surface with respect to said depletion direction indicates a supply status of said sheet product supply, and said dispenser comprising a radar sensor; said sensor being configured to emit a sensor beam; the method comprising:

providing a sensor echo signal indicative of a distance from said sensor to said boundary surface, and, when one or more reflective surfaces distinct from said boundary surface and at least partially reflecting said sensor beam are located between said sensor and said boundary surface, indicative of a distance from said sensor to said reflective surface(s), using said sensor; and determining a status of said dispenser using said sensor echo signal, the status including at least one of: a sheet supply status indicating the amount of sheet product in the storage volume of the dispenser; and a dispenser error.

2. The method according to claim 1, wherein said boundary surface is a surface of said sheet product supply from which sheet product is fed when said dispenser is in use.

3. The method according to claim 1, wherein at least one out of said one or more reflective surfaces is located between said sensor and said boundary surface when the sheet product travels in a direction toward the sensor and along a web path when the dispenser is in use.

4. The method according to claim 1, wherein at least one out of said one or more reflective surfaces is located in said storage volume between said storage volume minimum level (Min) and said storage volume maximum level (Max).

5. The method according to claim 1, wherein at least one of said one or more reflective surfaces comprises a dispenser element.

6. The method according to claim 1, wherein at least one of said one or more reflective surfaces comprises a sheet product element.

7. The method according to claim 1, wherein said step of determining said status of said dispenser comprises identifying a location of said boundary surface using said sensor echo signal.

8. The method according to claim 1, wherein said sensor echo signal indicates a sensor signal amplitude, and said step of determining said status of said dispenser comprises determining said status based on said sensor echo signal amplitude.

9. The method according to claim 1, wherein said step of determining said status of said dispenser comprises determining said location of said boundary surface along said depletion direction between said storage volume maximum level (Max) and said storage volume minimum level (Min) in said storage volume.

10. The method according to claim 1, wherein said step of determining said status of said dispenser comprises comparing said sensor echo signal to one or more reference sensor echo signals.

11. The method according to claim 10, wherein said one or more reference sensor echo signals comprises an empty dispenser reference signal retrieved from said dispenser with no sheet product supply therein.

12. The method according to claim 10, wherein said one or more reference sensor echo signals comprises one or more reference signals each corresponding to a predetermined status of said dispenser.

13. The method according to claim 12, wherein said predetermined status is one out of a ready to refill status, a sufficiently filled status and a close to depleted status.

14. The method according to claim 1, wherein said storage volume is divided along said depletion direction by one or more thresholds, and said step of determining said status of said dispenser comprises determining whether said location of said boundary surface is above or below said one or more thresholds, using said sensor echo signal.

15. The method according to claim 14, wherein one of said one or more thresholds is a refill threshold and, upon determining that said location of said boundary surface is above said refill threshold as seen along said depletion direction, determining that said status of said dispenser is to be ready for refill; and/or wherein one of said one or more thresholds is a depleted threshold, and, upon determining that said location of said boundary surface is above said depleted threshold, as seen along said depletion direction, determining that said status of said dispenser is close to be depleted.

16. The method according to claim 1, wherein said status is continuously indicative of said location of said boundary surface in said storage volume.

17. The method according to claim 1, further comprising Issuing a signal indicative of said status.

18. The method according to claim 1, wherein a control unit is configured to perform the steps of claim 1.

19. A computer program comprising program code means for performing the steps of claim 1 when said program is run on a computer.

20. A computer readable medium carrying a computer program comprising program code means for performing the steps of claim 1 when said program is run on a computer.

21. A dispenser for dispensing a sheet product for wiping, said dispenser defining a storage volume for housing a sheet product supply when said dispenser is in use, said storage volume extending along a depletion direction at least from a storage volume maximum level (Max) corresponding to a maximum sheet product supply in said dispenser to a storage volume minimum level (Min) corresponding to no sheet product supply in said dispenser, wherein said depletion direction along which a distance between a boundary surface of said sheet product supply and the volume maximum level (Max) varies as an amount of sheet product in said storage volume decreases upon feeding of said sheet product from said sheet product supply, wherein a location of said boundary surface with respect to said depletion direction indicates a supply status of said sheet product supply, said dispenser comprising a radar sensor; said sensor being configured to emit a sensor beam and being arranged to provide a sensor echo signal indicative of a distance from said sensor to said boundary surface, and, when one or more reflective surfaces distinct from said boundary surface and at least partially reflecting said sensor beam are located between said sensor and said boundary surface, indicative of a distance from said sensor to said reflective surfaces, so as to enable determination of a status of said dispenser, the status including at least one of: a sheet supply status indicating the amount of sheet product in the storage volume of the dispenser; and a dispenser error.

22. The dispenser according to claim 21, wherein said sensor is arranged to provide a sensor echo signal from said storage volume indicative of said distance from said sensor to said boundary surface for all possible locations of said boundary surface between said storage volume minimum level (Min) to said storage volume maximum level (Max).

23. The dispenser according to claim 21, wherein said boundary surface is a surface of said sheet product supply from which sheet product is fed when said dispenser is in use.

24. The dispenser according to claim 21, wherein, at least one out of said one or more reflective surfaces is located between said sensor and said boundary surface, when the sheet product travels in a direction toward the sensor and along a web path when said dispenser is in use.

25. The dispenser according to claim 21, wherein at least one out of said one or more reflective surfaces is located in said storage volume between said storage volume minimum level (Min) and said storage volume maximum level (Max), when said dispenser is in use.

26. The dispenser according to claim 21, wherein at least one of said one or more reflective surfaces comprises a dispenser element.

27. The dispenser according to claim 21, wherein at least one of said one or more reflective surfaces is a sheet product element.

28. The dispenser according to claim 21, wherein said dispenser comprises a web path along which sheet product is fed from said sheet product supply when said dispenser is in use, and, for at least one possible location of said boundary surface in said storage volume, said web path extends between said sensor and said boundary surface.

29. The dispenser according to claim 28, wherein said dispenser comprises a dispensing opening and said web path is a path in said dispenser along which said sheet product is fed from said sheet product supply when present in said storage volume to said dispensing opening.

30. The dispenser according to claim 21, wherein said sensor is arranged with respect to said sheet product supply such that a propagation direction of said sensor beam is along said depletion direction, preferably said propagation direction is generally parallel to said depletion direction.

31. The dispenser according to claim 21, wherein said storage volume is configured to contain a sheet product supply in the form of a stack of sheet product.

32. The dispenser according to claim 31, wherein said boundary surface is an upper boundary surface of said stack, as seen along a vertical direction when said dispenser is in a use position.

33. The dispenser of claim 21, further comprising:

a system for evaluating a status of a dispenser for dispensing a sheet product for wiping, the system comprising a dispenser according to claim 21 and including a control unit configured to perform the steps of:

providing a sensor echo signal indicative of a distance from said sensor to said boundary surface, and, when one or more reflective surfaces at least partially reflecting said sensor beam are located between said sensor and said boundary surface, indicative of a distance from said sensor to said reflective surface(s), using said sensor; and determining a status of said dispenser using said sensor echo signal.

34. The dispenser of claim 21, further comprising:

a monitoring system comprising one or more systems according to claim 33, wherein said systems are configured to report a determined status of said dispenser of said system to a local processing unit or to an external processing unit.

* * * * *